US006328705B1

(12) United States Patent
Hsieh

(10) Patent No.: US 6,328,705 B1
(45) Date of Patent: Dec. 11, 2001

(54) BRUSH WITH MEANS ADAPTED TO MASSAGE THE HEAD

(76) Inventor: Chin Wan Hsieh, No. 153, Sec. 1, Ta Tung Rd., Shetze, Taipei Hsien (TW)

( * ) Notice: Subject to any disclaimer, the term of this patent is extended or adjusted under 35 U.S.C. 154(b) by 0 days.

(21) Appl. No.: 09/603,914

(22) Filed: Jun. 26, 2000

(51) Int. Cl.[7] ..... A61H 15/00
(52) U.S. Cl. ..... 601/129; 601/128; 601/123
(58) Field of Search ..... 601/118–123, 125, 601/129, 131, 136–138; D24/211, 214

(56) References Cited

U.S. PATENT DOCUMENTS 2,653,598 * 9/1953 Torino ..... 128/57
4,139,312 * 2/1979 Marano et al. ..... 401/176
5,699,575 * 12/1997 Peifer ..... 15/23
6,098,233 * 8/2000 Chen ..... 15/110

FOREIGN PATENT DOCUMENTS 2 511 586 * 8/1981 (FR) ..... A46B/15/00

* cited by examiner

*Primary Examiner*—Justine R. Yu
(74) *Attorney, Agent, or Firm*—Bacon & Thomas, PLLC

(57) ABSTRACT

A brush having a handle, the handle having one end terminating in a bristle holder mount and an opposite end terminating in a handgrip, and a bristle holder mounted in the bristle holder mount and holding bundles of bristles, wherein the bristle holder mount is equipped with at least one first massaging wheel suspended at a front side thereof for massaging, and the handgrip has a second massaging wheel disposed at one end thereof remote from the bristle holder mount for massaging.

4 Claims, 5 Drawing Sheets

BRUSH WITH MEANS ADAPTED TO MASSAGE THE HEAD

BACKGROUND OF THE INVENTION

The present invention relates to brushes, and more particularly to such a brush, which is equipped with massaging wheels at front and rear sides thereof for massaging the head and the body to stimulate the circulation of blood.

A variety of brushes have been disclosed for use to smoothen the hair, or to clean the body. These implements are designed for a particular function only. It is practical to provide a brush with an added function without increasing much cost.

SUMMARY OF THE INVENTION

It is the main object of the present invention to provide a brush, which is equipped with massaging wheels for massaging the head and the body to stimulate the circulation of blood. According to one aspect of the present invention, the brush comprises at least two massaging wheels bilaterally protruded from the front side of the handle thereof in front of the bristle holder in the handle and adapted for rubbing over the head or the body to stimulate the circulation of blood. According to another aspect of the present invention, the handle has a rear end equipped with a massaging wheel adapted for massaging the back of the body.

DETAILED DESCRIPTION OF THE PREFERRED EMBODIMENT

Figure 1:
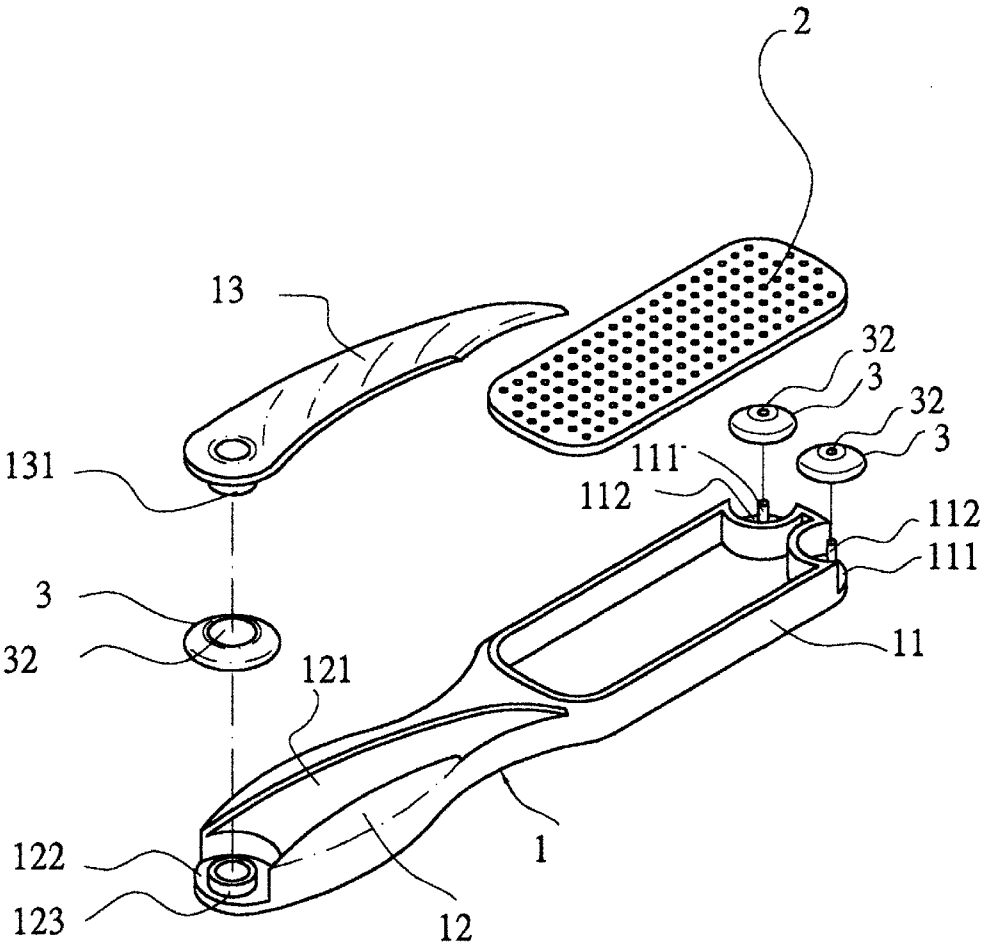
FIG. 1 is an exploded view of a hairbrush constructed according to the present invention.

Referring to FIG. 1, a hairbrush is shown comprising a handle 1, a bristle holder 2, and a plurality of massaging wheels 3. The handle 1 comprises a bristle holder mount 11 adapted to hold the bristle holder 2 and bristles (not shown) in the bristle holder 2, and a handgrip 12 integral with one end of the bristle holder mount 11. The handgrip 12 comprises a receiving recess 121 adapted to rcceive a clamping plate 13, an end notch 122 at one end of the receiving recess 121, and a socket 123 disposed in the end notch 122. The clamping plate 13 has a downward stud 131 disposed at its one end and adapted for plugging into the socket 123. The bristle holder mount 11 comprises two front notches 111, and two upright axles 112 respectively disposed in the front notches 111. The massaging wheels 3 each have a center through hole 32, and a smoothly arched periphery.

Figure 2:
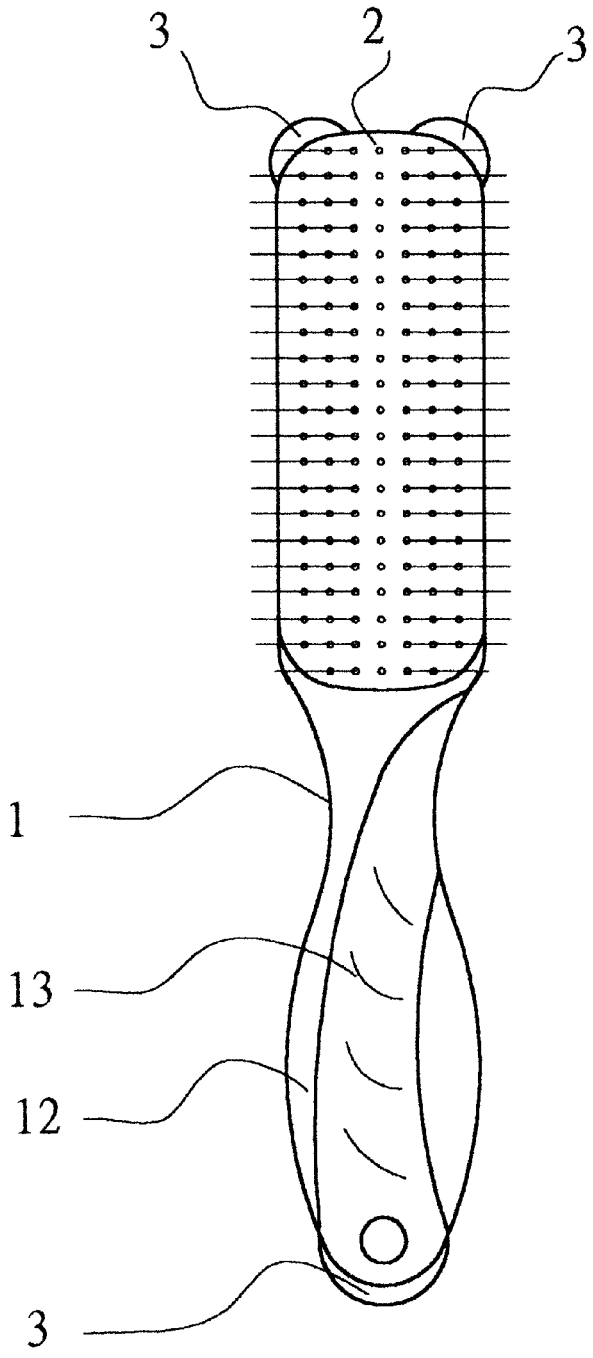
FIG. 2 is a front plain view of the hairbrush shown in FIG. 1.
Figure 3:
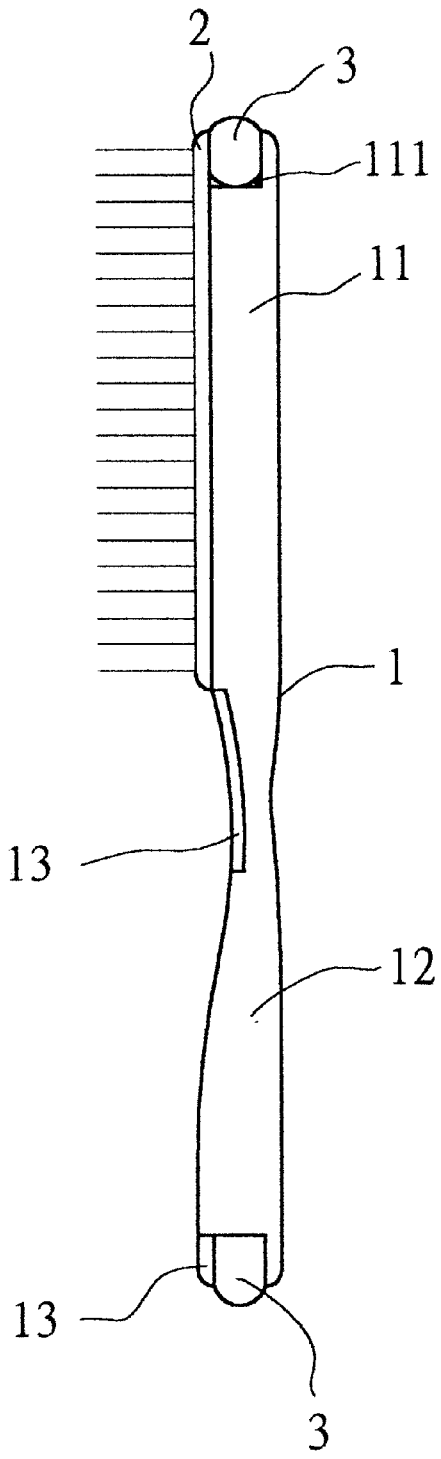
FIG. 3 is a side plain view of the hairbrush shown in FIG. 1.

Referring to FIGS. 2 and 3 and FIG. 1 again, the massaging wheels 3 are respectively rotatably mounted on the axles 112 and the socket 123 in the front notches 111 and the end notch 123, and then the clamping plate 13 is mounted in the receiving recess 121 with the downward stud 131 plugged into the socket 123 to hold the corresponding massaging wheel 3 in place, and then the bristle holder 2 is installed in the bristle holder mount 11 and forced into engagement with the axles 112 to hold the corresponding massaging wheels 3 in place. After installation, the hairbrush is used to smooth the hair. Alternatively, the hairbrush can be pressed against the head or the body, and moved to rub the massaging wheels 3 against the head or the body in order to stimulate the circulation of blood. When rubbing against the head or the body, the massaging wheels 3 are respectively turned about the axles 112 and the socket 123.

Figure 4:
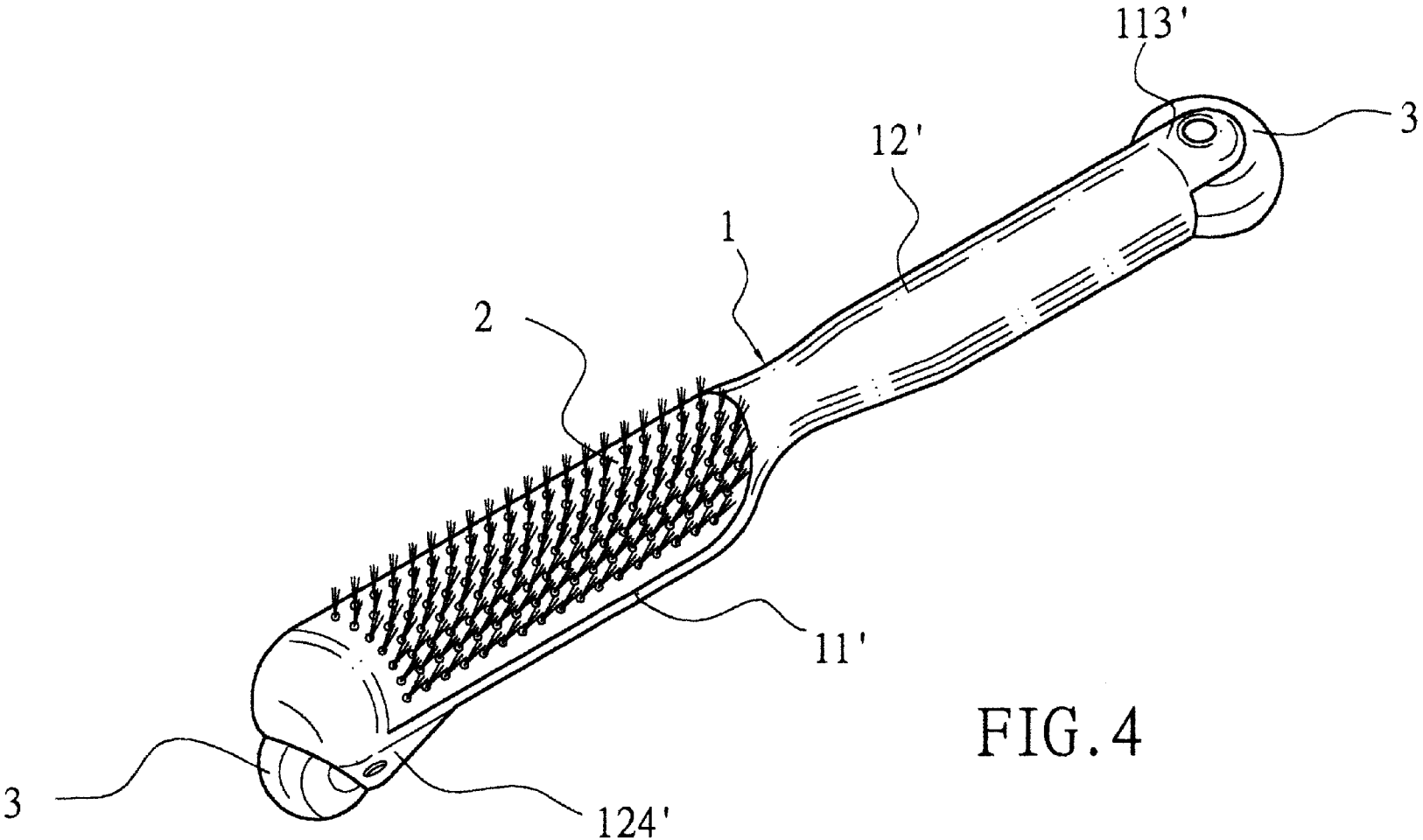
FIG. 4 is an elevational view of an alternate form of the brush according to the present invention.

FIG. 4 shows an alternate form of the present invention. According to this alternate form, the handgrip 12' of the handle 1 has one end terminating in a wheel holder 113' holding a massaging wheel 3, and the bristle holder mount 11' of the handle 1 has one end integral with the handgrip 12' and an opposite end provided with a bottom wheel holder 124' holding another massaging wheel 3.

Figure 5:
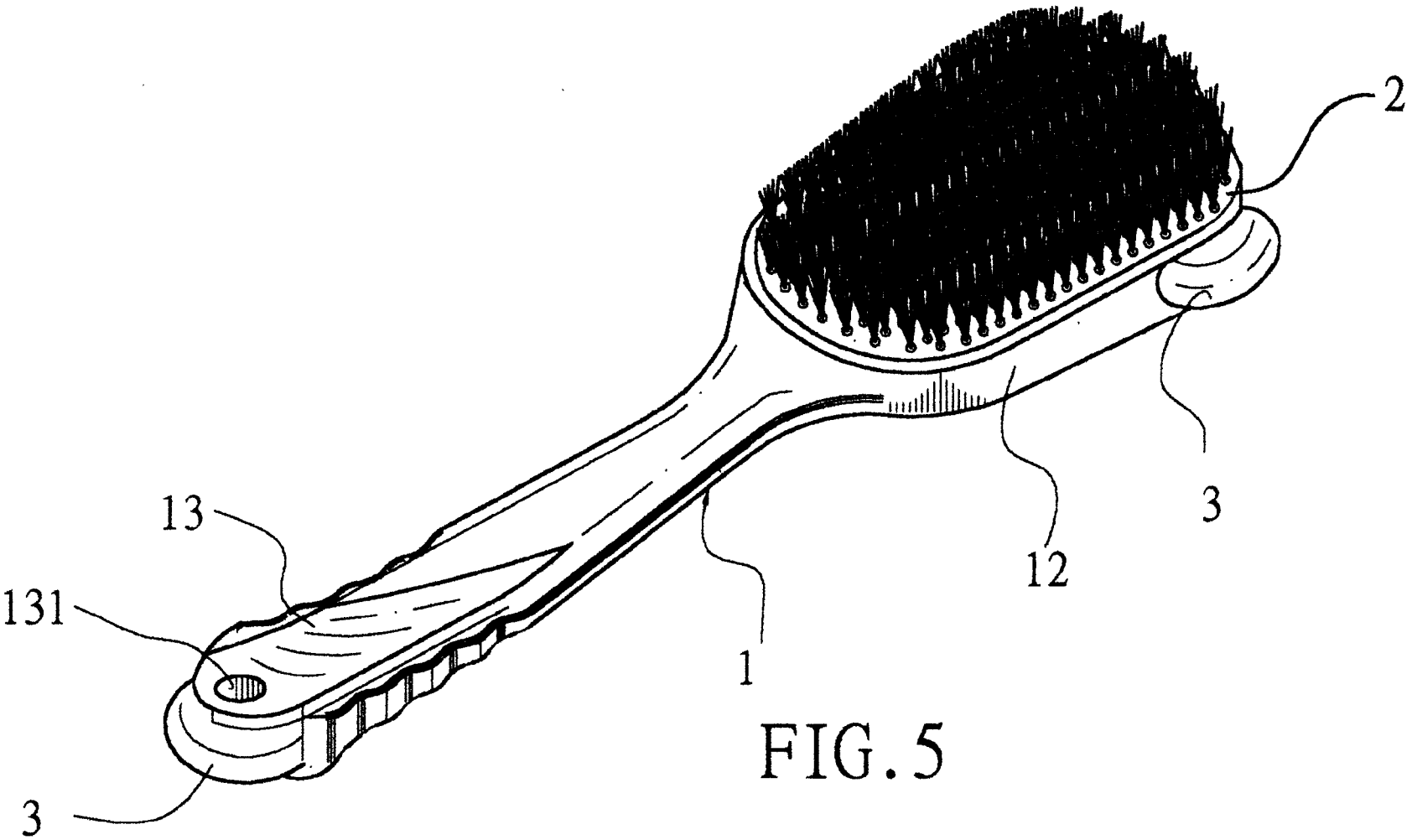
FIG. 5 is an elevational view of another alternate form of the present invention.

FIG. 5 shows another alternate form of the present invention. According to this alternate form, the brush is designed for cleaning the body.

Figure 6:
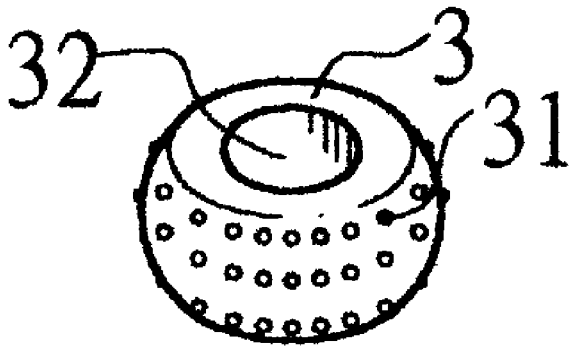
FIG. 6 is an elevational view of an alternate form of the massaging wheel according to the present invention.

FIG. 6 shows an alternate form of the massaging wheel 3. According to this alternate form, the massaging wheel 3 has raised portions 31 arranged over the periphery thereof for massaging.

What the invention claimed is:

1. A brush comprising:

a) a handle including a bristle holder mount having a first end, a handgrip having a first end, the first end of the bristle holder mount being formed integral with the first end of the handgrip;

b) a bristle holder mounted in the bristle holder mount, a plurality of bundles of bristles held by the bristle holder;

c) the bristle holder mount including at least one massaging wheel mounted at a second end thereof; and d) the handgrip including an end notch formed at a second end thereof remote from the bristle holder mount, a socket positioned in the end notch, a massage wheel rotatably supported on the socket, a receiving recess, a clamping plate mounted in the receiving recess, the clamping plate including a stud engaged within the socket for maintaining the massaging wheel in position on the socket.

2. The brush of claim 1 wherein the massaging wheels of the bristle holder mount and the handgrip each include a plurality of raised portions extending around the periphery thereof.

3. A brush comprising:

a) a handle including a bristle holder mount having a first end, a handgrip having a first end, the first end of the bristle holder mount being formed integral with the first end of the handgrip;

b) a bristle holder mount including a front notch formed in a second end thereof, an upright axle positioned in the front notch, a massaging wheel rotatably supported on the upright axle;

c) a bristle holder mounted in the bristle holder mount, a plurality of bundles of bristles held by the bristle holder; and d) the handgrip including a rotatable massage wheel disposed at a second end thereof remote from the bristle holder mount.

4. The brush of claim 3 wherein the massaging wheels of the bristle holder mount and the handgrip each include a plurality of raised portions extending around the periphery thereof.

* * * * *